US006312361B1

(12) United States Patent
Hayes

(10) Patent No.: US 6,312,361 B1
(45) Date of Patent: Nov. 6, 2001

(54) SYNTHETIC SAND FRONTAL TRAINING SHOE

(76) Inventor: Kenneth Scott Hayes, One Ernest Ct., Kings Park, NY (US) 11754

( * ) Notice: Subject to any disclaimer, the term of this patent is extended or adjusted under 35 U.S.C. 154(b) by 0 days.

(21) Appl. No.: 09/415,514

(22) Filed: Oct. 9, 1999

Related U.S. Application Data

(63) Continuation-in-part of application No. 08/834,370, filed on Apr. 16, 1997, now abandoned.

(51) Int. Cl.[7] ..... A63B 23/04; A63B 5/16; A63B 21/00; A43B 5/00

(52) U.S. Cl. ..... 482/51; 36/28; 36/106; 36/114; 482/14; 482/74; 482/79

(58) Field of Search ..... 482/14, 15, 51, 482/74, 79, 105; 36/28, 106, 114, 132

(56) References Cited

U.S. PATENT DOCUMENTS 3,279,102 * 10/1966 Seeber, Sr. ..... 482/105
3,739,500 * 6/1973 Cox ..... 482/51
4,170,078 * 10/1979 Moss ..... 36/28
4,297,797 * 11/1981 Meyers ..... 36/44
4,495,715 * 1/1985 Frederickson et al. ..... 36/114
4,697,361 * 10/1987 Ganter et al. ..... 36/28
4,843,672 * 7/1989 Fasse ..... 36/132
4,934,073 * 6/1990 Robinson ..... 36/28
4,955,147 * 9/1990 Bos ..... 36/28
5,339,542 * 8/1994 Kim ..... 36/132
5,461,799 * 10/1995 Kim ..... 36/132
5,675,915 * 10/1997 Faughn et al. ..... 36/114
5,694,706 * 12/1997 Penka ..... 36/132

* cited by examiner

*Primary Examiner*—Mickey Yu
*Assistant Examiner*—Victor K. Hwang

(57) ABSTRACT

An athletic training shoe that is designed to simulate beach training (exercising in sand) so as to provide the user with all of the positive effects of beach training which result in improved running speed, vertical jump, pedal agility and quickness. Such benefits are easily understood where greater demands are placed on an athlete's muscles when walking, running, or jumping on a beach as opposed to other common surfaces. The muscles of the lower leg are strengthened and elongated simultaneously as they are put through a broader range of motion. The athletic training shoe is comprised of a highly pliable, foot-receiving member which places the user's foot in an ample depth of sand simulating material contained by a material holding element, positioned specifically under the front portion of the user's foot. This causes the user's weight and momentum to be supported by the muscles of the lower leg and foot that control flexion of the foot and toes. Straps are used to secure the user's foot in the foot-receiving member as well as to affix and position the material holding element under the front portion of the user's foot. When worn during a variety of plyometric and agility exercises, an intensified overall workout results.

20 Claims, 2 Drawing Sheets

SYNTHETIC SAND FRONTAL TRAINING SHOE

CROSS-REFERENCE TO RELATED APPLICATIONS

This application is a continuation in part of application Ser. No. 08/834,370 filed on Apr. 16, 1997 currently entitled, Variable Surface Resistance Training Device now abandoned. The present application is a continuation in part to the above mentioned parent application and claims the benefit of its entire disclosure.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to athletic training footwear that specifically enhances running speed, vertical jump, pedal quickness, and pedal balance. In the preferred embodiment of the present invention, synthetic sand is used as the sand simulating material at each of the user's feet, and therefore, simulates the positive effects of beach training (exercising in deep sand). Although it is not a primary objective of the present invention to provide a cushioning effect to the user's feet and related joints, a shock-absorbing effect does, in fact, naturally result. The invention is therefore indirectly related to the field of pedal cushioning which includes therapeutic footwear, and footwear inserts. The present invention utilizes an improved sand simulating material at a specific depth and position under the user's foot for the primary purpose of strengthening the muscles of the lower leg and foot that control plantar flexion of the foot (push-off) and more specifically, the flexion (push-off) of the toes.

2. Description of the Related Art

Because two separate fields of the invention are encountered-recreational/athletic footwear/devices and therapeutic footwear/inserts, related prior art exists from both fields. Several patents exist from the field of recreational footwear. Braun (DT 2,435,094) discloses a pedal attachment comprising an upper platform, and a flat sole wherein steel springs or plastic and foam create a spring effect for recreational walking or jumping. Gluecksmann (U.S. Pat. No. 337,146) discloses a recreational spring shoe that is contained by a continuous wall beneath the user's feet. Lekhtman (U.S. Pat. No. 5,205,798) discloses footwear that comprises a detachable arched spring member that has safety features. In Braun, Gluecksmann, Lekhtman, and related art, the primary goal is to add spring or bounce to each step where the user's entire foot, heel to toe, is supported and affected. In each case the desired effect is to facilitate running and jumping by adding to the equal and opposite force that standard ground contact provides. Standard ground contact is provided by such surfaces as hard earth, gym floor, track surfaces, pavement, etc. In contrast, it is the primary goal the present invention is to specifically decrease the equal and opposite force that standard ground contact provides for the purpose of intensified athletic training by simulating beach training (exercising in deep sand).

Two patents are related from the field of athletic training footwear and/or devices. Cox (U.S. Pat. No. 3,739,500) discloses a shoe that supports only the front of the user's foot for use in athletic training. Kim (U.S. Pat. No. 5,461,799) discloses an attachment to the front of the user's existing footwear for the same purpose. In both cases, the platform element is a firm structure that elevates the foot while providing an equal and opposite ground-contacting force through that structure. In fact, Kim describes the platform element as being, " . . . a firm, resilient material, which is resistant to compression . . . " (U.S. Pat. No. 5,461,799). Where both Cox and Kim maintain an equal and opposite ground contact through the use of 'firm, resilient' platform elements, the present invention decreases the equal and opposite force that standard ground contact provides through the use of a contained sand simulating material as the pillar element. The result is intensified overall athletic training and a broader range of motion in strengthening the muscles of the lower legs and feet.

Several patents exist in the indirectly related field of pedal cushioning in the form of therapeutic footwear, and footwear inserts. Ganter (U.S. Pat. No. 4,697,361) discloses a shock-absorbing shoe insert that utilizes sand in thin, strategically placed chambers along the user's entire foot. Meyers (U.S. Pat. No. 4,297,797) discloses a therapeutic shoe that comprises sand and air beneath the user's entire foot. Bos (U.S. Pat. No. 4,955,147) discloses a shoe having a flat inner surface comprising, 'highly springy elastic material' to achieve the desired effects afforded by the shoe. Moss (U.S. Pat. No. 4,170,078) discloses a sole for a shoe that is ergonomically designed for the entire foot that utilizes chambers of loose sand beneath the surface. In Ganter, Meyers, Bos, Moss, and related prior art including those that utilize gels, liquids, air, sand, and other materials, the primay focus is foot comfort and therapeutic value where the entire foot is met with cushioning support. Because it is the primary focus of the present invention to provide the user with an intensified athletic workout, only the front of the user's foot corresponding to the ball of the foot and forward including the toes is supported by a substantial depth of sand simulating material (2"–3"). The heel is left unsupported so that the muscles of the lower leg and foot are automatically employed to support the user's bodyweight. Because the primary focus of the present invention is to intensify athletic training as opposed to create therapeutic value, it takes a novel form and utilizes an improved material in the preferred embodiment for that purpose.

BRIEF SUMMARY OF THE INVENTION

Beach training (exercising in deep sand) is a recognized form of athletic training, but until recently has not been fully studied or compared to other forms of athletic training such as weight training, plyometrics, isometric resistance training, etc. Beach training provides for a more intense, more demanding athletic workout both aerobically and anaerobically when compared to other forms of athletic training. Therefore, it is a primary objective of the present invention to simulate beach training by placing an ample depth of sand simulating material (2"–3") under each of the user's feet in the form of athletic training footwear.

It is another objective of the present invention to focus on exercising the muscles of the lower leg that control plantar flexion of the foot by supporting only the front of the user's foot which thereby forces those muscles to support the user's bodyweight and momentum during each step and/or athletic movement.

It is a further objective of the present invention to make use of a highly pliable foot-receiving member such as an elastic sock or thin-soled athletic shoe so as to maximize the ability of the ball of user's foot and the user's toes to dig into the sand simulating material thereby concentrating on strengthening the muscles of the lower leg and foot that control flexion of the toes.

It is yet another objective of the present invention to make use of rear crossing straps that reset the sand simulating material under the front portion of the user's feet laterally after each step and/or athletic movement.

It is still another objective of the present invention to make use of adjustable side straps to reset the sand simulating material under the front portion of the user's feet lengthwise after each step and/or athletic movement.

Where all of the aforementioned objectives are met in the present invention, users will be afforded all of the benefits of beach training anywhere they choose to exercise with the ultimate goal of improving any or all of the following athletic abilities:

Running Speed

Vertical Jump

Pedal Agility

Pedal Balance

Cardiovascular System

Improving any or all of the latter athletic abilities is facilitated by the following benefits of beach training:

A more intense overall workout aerobically and anaerobically.

A shock-absorbent medium which is helpful for safe plyometric jumping and bounding which is historically hard on an athlete's joints (ankles, knees, hips).

A broader range of motion for both the feet and the toes, which works more of each of the muscles used in athletic movements.

The ability to specifically strengthen the muscles used in flexion of the toes. (A certain depth of sand (2"–3") must be utilized in order to achieve each of the latter two benefits.)

The muscles that are primarily affected during athletic training with the present invention are the two Gastrcnemius muscles and the Soleus muscle of the lower leg that control plantar flexion of the foot, and, the Flexor hallucis muscle, Flexor digitorum muscle, and Adductor hallucis muscle of the lower leg and foot that control flexion of the toes.

The invention utilizes a highly pliable foot-receiving member such as an elastic sock or thin-soled athletic shoe to securely contain the user's foot. Not only does this element contribute to a lighter overall weight of the invention, but, more importantly, it allows the user's toes to dig freely into the sand simulating material. The benefit of strengthening the muscles that control flexion of the toes will be studied as a breakthrough in athletic training, hypothesizing improved pedal balance and explosive push-off. The front portion of the foot-receiving member is sewn directly into the element that contains the sand simulating material (material holding element). It can be a variety of pliable materials that will durably hold up, such as canvas, plastic, cloth, rubber, or a combination thereof. This element is attached at the bottom and front to the curved, semi-pliable, durable bottom sole member with aluminum rivets (light) or other permanent means of fastening. The bottom sole member provides traction for a variety of surfaces and maintains a wide base for the material holding element. Light, durable straps serve to restrict the lateral and rearward motion of the foot by securing over top of the foot-receiving member, adjustably, and attaching to the bottom sole member in the front as well as crossing in the back. Another strap allows for precise sizing to the user's foot by securing adjustably around the heel of the foot-receiving member.

The features that comprise the present invention serve to maximize the effective simulation of beach training in achieving athletic benefit to the user. The precise construction, manner and process of making and using, and specific embodiment of the present invention are best understood as read in conjunction with the attached drawings in the following sections.

DETAILED DESCRIPTION OF THE INVENTION

Figure 1:
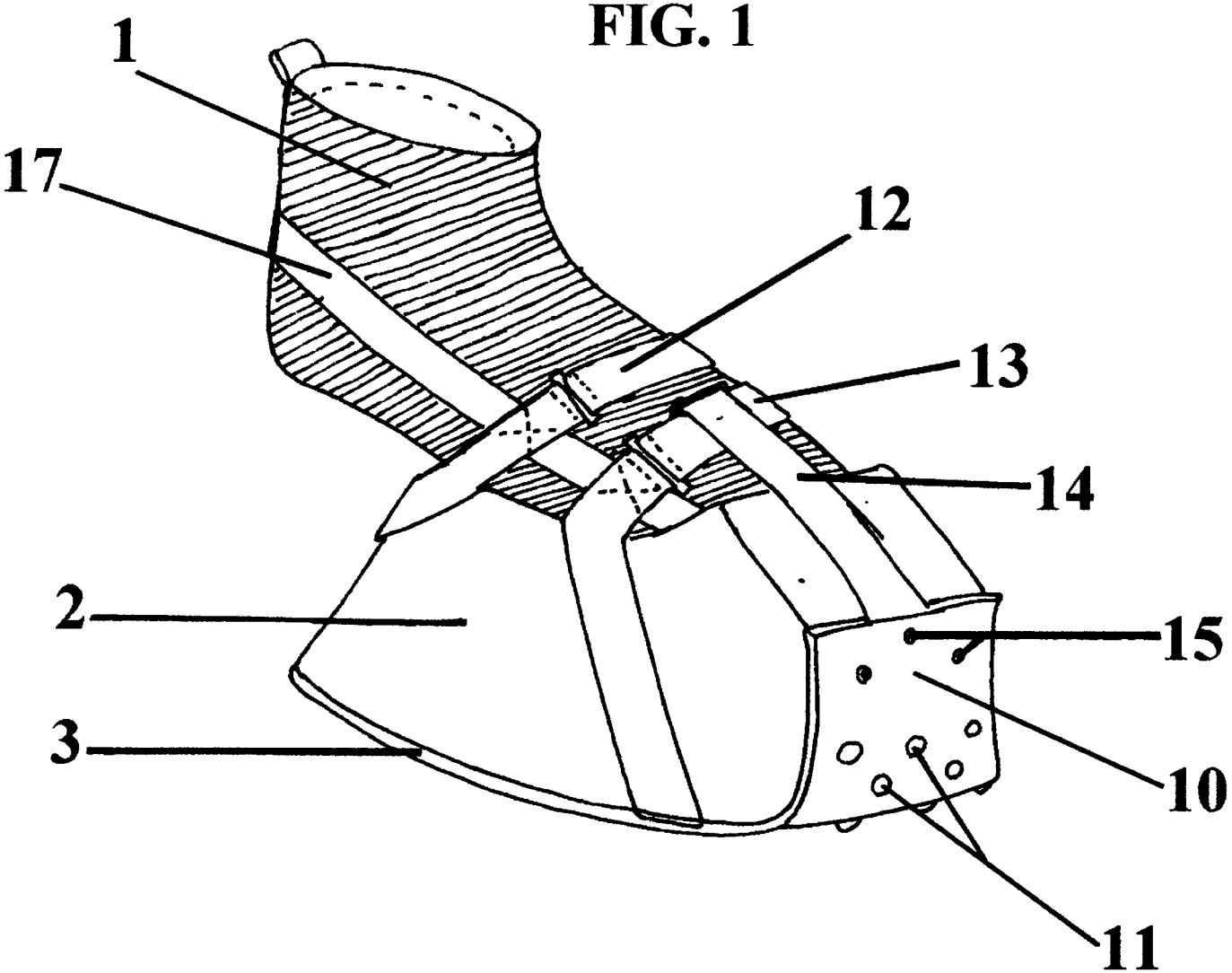
FIG. 1 is the perspective view of the present invention showing the full outer construction.

Referring first to FIG. 1, there is shown all components of the outer construction of the present invention and their relative position and attachment to each other. Foot-receiving member 1 is shown attached to material holding element 2 only at the front of the foot corresponding to the ball of the user's foot and forward including the toes. It is durably sewn around the outer perimeter of foot-receiving member 1 so that the area corresponding to the toes of the user's foot are within material holding element 2 as shown. Foot-receiving member 1 is preferred to be a highly pliable elastic sock allowing for flexion of the toes and a light overall construction. Material holding element 2 is preferred to be made of a light, durable canvas which is attached to bottom sole member 3 with light, aluminum rivets 15 around the perimeter and at the upright front portion 10 of bottom sole member 3. Bottom sole member 3 is preferred to be a thin, light, semi-pliable, durable material like many plastics with traction 11 throughout the entire ground-contacting surface as show in FIGS. 2 and 3.

Figure 2:
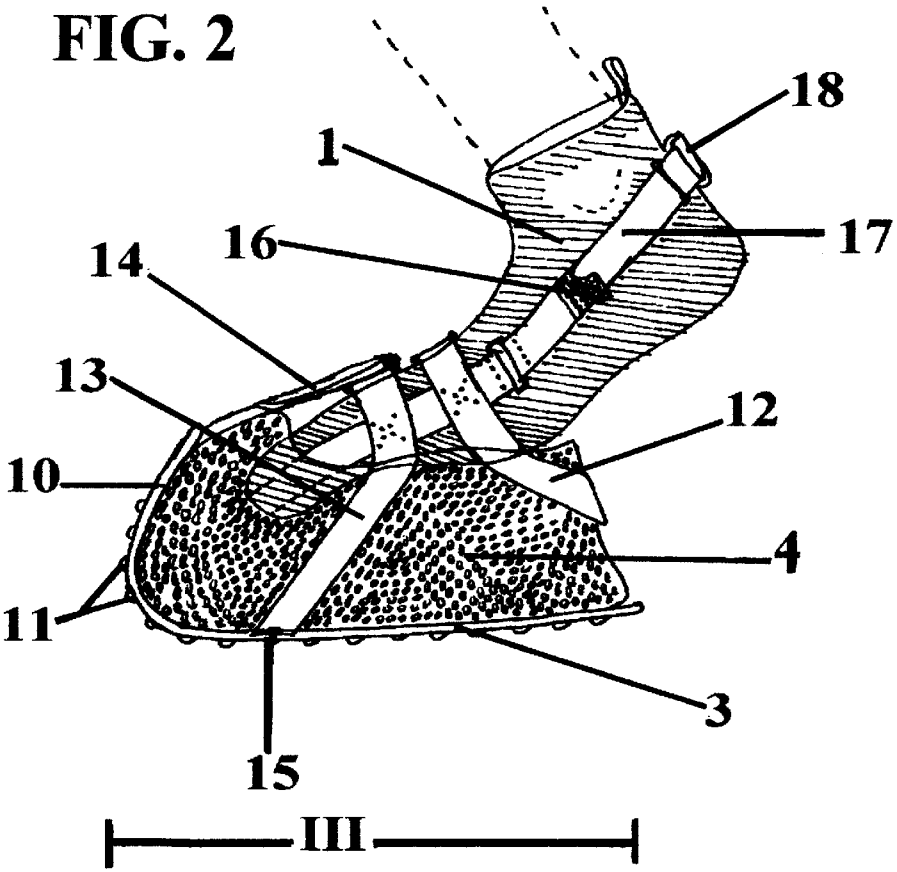
FIG. 2 is the lateral side view (cross-section) of the present invention showing the internal construction and the relative position of the user's foot.

Securing straps 12, 13, and 14 adjustably attach foot-receiving member 1 to bottom sole member 3 in the rear, sides, and front respectively. They are attached at each point with light aluminum rivets 15. Securing straps 12, 13, and 14 are preferred to be made of light, durable webbing material. Securing straps 12, 13 and 14 are adjustable through blocks on the top side of foot-receiving member 1 securing with the preferred hook & loop fastening means 16 as shown in FIG. 2. Sizing heel strap 17 is durably sewn into foot-receiving member 1 at various points only around the front portion of foot-receiving member 1. It goes around the heel and through a sewn in strap loop 18 as shown in FIG. 2. Sizing heel strap 17 goes through a block and secures with hook & loop fastening means 16 as seen in FIG. 2, and is made of light, durable webbing material.

Figure 3:
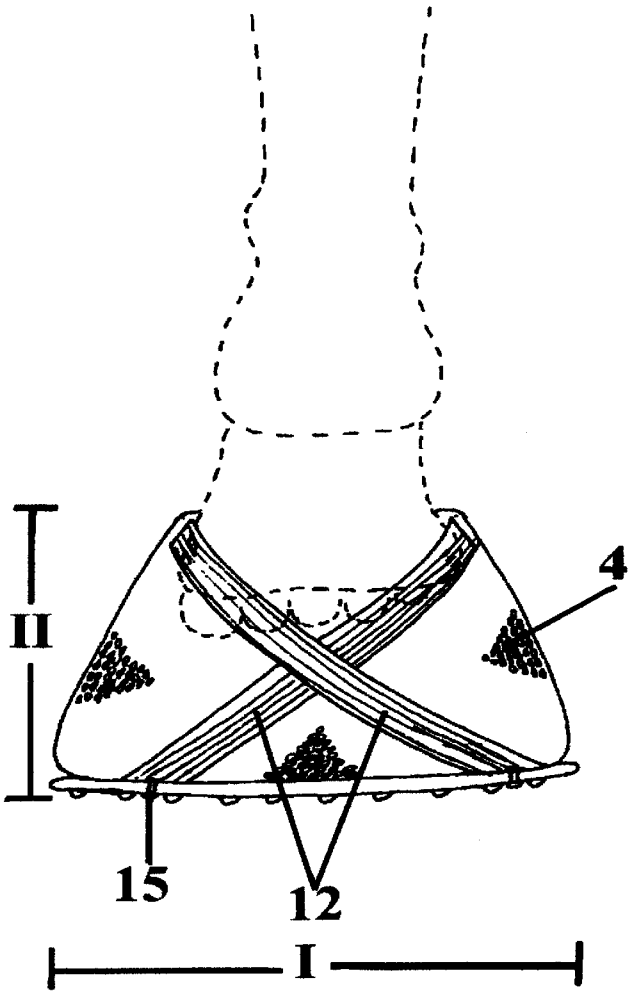
FIG. 3 is the rear view of the present invention showing the relative position of the user's foot in the same position as that of FIG. 2.

Securing strap 12 goes from where it is sewn into sizing heel strap 17 on each side, behind material holding element 2, crossing each other before being attached on opposite sides to bottom sole member 3 as shown in FIG. 3. This crossing configuration prevents lateral sliding of the user's foot off material holding element 2 and also serves to reset sand simulating material 4 under the ball of the user's foot laterally after every step and/or athletic movement.

Securing strap 13 goes from where it is sewn into sizing heel strap 17 at an angle forward to where it is attached to bottom sole member 3 at each side. This prevents excessive rearward movement of the user's foot during push-off and serves to reset sand simulating material 4 under the user's foot lengthwise after every step and/or athletic movement. Securing strap 13 is adjustable to accommodate a range of foot sizes and to vary the depth of sand simulating material 4 that the user's foot will encounter.

Securing strap 14 goes from a block located between securing straps 12 and 13 to the upright portion 10 of bottom sole member 3 where it is attached using light aluminum rivets 15 as shown in FIG. 1. Securing strap 14 is adjustable to accommodate a range of foot sizes and to vary the depth of sand simulating material 4 that the user's foot will encounter.

In FIG. 2 sand simulating material 4 is contained by material holding element 2. FIG. 2 shows the user's toes digging into sand simulating material 4 at the beginning of push-off. The preferred material for sand simulating material 4 is synthetic sand, specifically, polyolefin granules, such as those produced by Dow Chemical. The desired effect is to simulate beach training (exercising in deep sand) where a more intense athletic workout is achieved. The more intense athletic workout is due entirely to the properties that are inherent in the sand itself.

Those properties are:

- Sand is force-absorbent in that it will give and spread when a concentrated force is applied to it. When a runner's foot lands in the sand, the sand tends to give and spread under the force and momentum of the runner's bodyweight. When the same foot pushes off in stride, the sand tends to further give and spread. When compared to standard, rigid ground surfaces like that of hard earth, gym floor, track surface, pavement, etc., sand provides a substantially decreased surface resistance. That is to say, sand does not provide the equal and opposite force that is provided by standard, rigid ground surfaces; the 'opposite force' is substantially less than equal. This is what causes the muscles that are associated with athletic movement to work harder during the movement. It is also what causes the associated muscles to encounter a broader range of motion during the movement thereby exercising and strengthening more of the muscle itself.
- Sand has no resiliency. That is to say, it is not a property of sand to retake its form and shape once a force has altered it. In the example of the runner's foot impacting the sand and then pushing off, an indentation is left in the sand. The indentation serves to prove that there was no resilient force whatsoever to act opposite of the force of the runner's foot pushing off. This further contributes to associated muscles working harder and at a broader range of motion during athletic training.
- Sand does not require an airtight holding material. That is to say, it is possible to hold sand within a material that allows air to move freely into and out of that material while still effectively holding the sand. By comparison, liquids, gels, and gasses do require an airtight holding medium. This is an important property of sand when viewed in the scope of the present invention where sand simulating material 4 travels with the user's foot and encounters severe impact at each ground contact.

Synthetic sand is chosen in the preferred embodiment of the present invention because it possesses all of the aforementioned properties with the added benefits of being lighter than actual sand filling an equivalent space. Furthermore, each granule of the chosen synthetic sand is pliable to a certain extent which adds to its force-absorbing attributes without adding to its overall resiliency as a substance. There are many other materials, substances, and/or matter that possess some or all of the properties described above and they are- various liquids, gels, gases, foams & foam-rubbers, and assorted hybrid materials. Hybrid materials are those materials that may contain a combination of materials to achieve the desired result.

There are three reasons related to the properties listed above that explain why synthetic sand is the material disclosed in the preferred embodiment of the present invention. First, synthetic sand acts like actual beach sand in that it is non-resilient and force-absorbent tending to absorb, spread, and give way to a concentrated force. Second, each synthetic sand granule is pliable which increases its force-absorbing and resulting cushioning properties without adding to its overall resiliency. Third, synthetic sand is much lighter than actual sand, assorted gels, and liquids which is a benefit to the present invention. There are, however, various other materials such as foams and foam-rubbers and other hybrid materials that are as light or lighter than synthetic sand but are resilient by nature which decreases their non-resilient, force-absorbing properties and consequently their effectiveness in intensifying athletic training for the most part.

In FIG. 3 the width of bottom sole member 3 and that of the bottom portion material holding element 2 are shown relative to, and proportional to, the user's foot. The ideal width of the distance shown by sectional designation I is 5"–7" depending on the size of the user's foot. This width provides a stable base for the user's foot and prevents the user's foot from sliding off material holding element 2.

In FIG. 3 the height of material holding element 2 is shown relative to, and proportional to, the size of the user's foot. The ideal height indicated by sectional designation II is 2"–3". This height provides ample vertical space for the ball of the user's foot and the user's toes to dig in during push-off. The ideal length of the present invention from front to back is 6"–9" depending on the size of the user's foot as shown in FIG. 2 by sectional designation III.

The preferred embodiment of the present invention involves 3–5 sizes to cover the full range of men's and women's foot sizes. Specific training programs exist for use with the invention that include various plyometric and agility exercises that focus on flexion of the foot and toes, as well as a new form of training designed to increase muscle strength and flexibility simultaneously.

The present invention intensifies athletic training at each phase of a muscle's contraction during athletic movements. When the user's foot first contacts the ground, muscles contract eccentrically, absorbing the user's bodyweight and momentum where the sand simulating material 4 absorbs shock and spread under the impact. As the muscles of the lower leg begin to transfer the user's bodyweight and momentum, they begin to contract concentrically which begins push-off of the foot. The sand simulating material 4 will give a bit more making the related muscles work harder through a broader range of motion. At the end of push-off, the toes can dig in to the sand simulating material 4 having the same effect on the muscles of the lower leg and foot that control flexion of the toes. Upon lifting of the user's foot, securing straps 12 and 13 straighten and force material holding element 2 back under the ball and toes of the user's foot, resetting it for the next ground contact.

The previous account of the preferred embodiment of the present invention specifically describes one proven configuration of the components and actors that contribute to simulating the positive effects of beach training (exercising in deep sand). However, it should be acknowledged, to those of ordinary skill in the art, that changes in the form and detail of those components and factors can be made without departing from the spirit and scope of the invention as described in the following claims.

I claim:

1. An athletic training shoe for simulating a deep sand training environment where an individual's forefoot digs into deep sand during push-off, the athletic training shoe comprising:

a material-holding element having a front, a bottom, and pliable sides;

a foot-receiving member attached to the material-holding element such that only a bottom, forefoot portion of said foot-receiving member overlies said material-holding element;

a volume of sand simulating material contained within said material-holding element and filling said material-holding element to a depth up to at least said bottom of said forefoot portion of said foot-receiving member;

a bottom sole member attached to said bottom of said material-holding element;

a plurality of securing straps connecting said bottom sole member to said foot-receiving member to affix and position said material-holding element therebetween;

said sand simulating material is a force-absorbent material providing substantially no resilient rebounding force; and wherein said depth of said volume of sand simulating material is of a depth such that said forefoot portion of said foot-receiving member displaces a quantity of said sand simulating material when an individual wearing the athletic training shoe pushes-off to simulate the deep sand training environment, and further wherein said plurality of securing straps repositions said material-holding element and said sand simulating material relative to said foot-receiving member for a subsequent push-off event.

2. The athletic training shoe of claim 1, wherein said foot-receiving member has a heel portion that is cantilevered relative to said material-holding element, such that only said forefoot portion of said foot-receiving member is directly supported by said sand simulating material within said material-holding element.

3. The athletic training shoe of claim 1, wherein said bottom sole member includes traction elements for engagement with a ground surface.

4. The athletic training shoe of claim 1, wherein said bottom sole member has an upright front end portion to protect a front portion of said material-holding element.

5. The athletic training shoe of claim 4, wherein said upright front end portion of said bottom sole member includes traction elements.

6. The athletic training shoe of claim 1, wherein said plurality of securing straps comprises at least one rear securing strap, at least one side securing strap, and at least one front securing strap.

7. The athletic training shoe of claim 1, wherein said plurality of securing straps are adjustable to accommodate various foot sizes and to adjust a relative position of said bottom of said forefoot portion of said foot-receiving member to said volume of sand simulating material.

8. The athletic training shoe of claim 1, wherein said sand simulating material comprises a material selected from the group consisting of sand, synthetic sand, liquid, gel, foam, foam-rubber, and hybrid material.

9. The athletic training shoe of claim 1, wherein said foot-receiving member comprises a pliable, elastic sock.

10. The athletic training shoe of claim 1, further comprising an adjustable heel strap attached to the foot-receiving member to permit fitting said foot-receiving member to various foot sizes.

11. The athletic training shoe of claim 1, wherein said sand simulating material comprises polyolefin granules.

12. The athletic training shoe of claim 1, wherein the depth of said sand simulating material is between 2 to 3 inches.

13. An athletic training shoe for use in simulating exercising in sand such as in training on a beach, said athletic training shoe comprising:

a material-holding element adapted to be positioned under only a front portion of a user's foot corresponding to the ball of the foot and forward including the toes, said material-holding element containing a prescribed depth of sand simulating material;

a foot-receiving member substantially pliable so as to allow the ball of the user's foot and the user's toes to be active in push-off within said sand simulating material, a front portion of said foot-receiving member attached to said material-holding element and a rear, bottom portion of said foot-receiving member unattached to said material-holding element;

a sizing heel strap adjustably attached to said foot-receiving member so that said foot-receiving member can securely fit a range of foot sizes;

a bottom sole member;

at least one rear securing strap to conjoin said foot-receiving member to said bottom sole member thereby affixing and positioning said material-holding element therebetween;

at least one side securing strap to conjoin said foot-receiving member to said bottom sole member thereby affixing and positioning said material-holding element therebetween; and at least one front securing strap to conjoin said foot-receiving member to said bottom sole member thereby affixing and positioning said material-holding element therebetween, wherein said sand simulating material is a force-absorbent material providing substantially no resilient rebounding force.

14. The athletic training shoe of claim 13, wherein said sand simulating material comprises synthetic sand.

15. The athletic training shoe of claim 13, wherein said sand simulating material comprises a material selected from the group consisting of a liquid, a gel, a gas, a foam, a foam-rubber, and a hybrid material.

16. The athletic training shoe of claim 13, wherein said bottom sole member is constructed of a durable, semi-pliable material having an upright front portion and a bottom portion, said upright front portion and said bottom portion having traction elements thereon.

17. The athletic training shoe of claim 13, wherein said at least one side securing strap is adjustable to accommodate a range of foot sizes and to vary the depth of sand simulating material encountered by a user's foot.

18. The athletic training shoe of claim 13, wherein said at least one front securing strap is adjustable to accommodate a range of foot sizes and to vary the depth of sand simulating material encountered by a user's foot.

19. The athletic training shoe of claim 13, wherein the prescribed depth of said sand simulating material is between 2 to 3 inches.

20. The athletic training shoe of claim 13, wherein said foot-receiving member comprises an elastic sock.

* * * * *